United States Patent [19]

Hogue

[11] 4,126,347

[45] Nov. 21, 1978

[54] PUMP HOUSING SLING

[76] Inventor: Donald E. Hogue, 4504 Danville Rd., Brandywine, Md. 20613

[21] Appl. No.: 841,868

[22] Filed: Oct. 13, 1977

[51] Int. Cl.[2] ..... B66C 1/20

[52] U.S. Cl. ..... 294/74

[58] Field of Search ..... 294/74 R, 78 R, 82 R, 294/67 B; 269/95; 254/192, 194, 195

[56] References Cited

U.S. PATENT DOCUMENTS

| | | | |
|---|---|---|---|
| 3,170,723 | 2/1965 | Halvorsen et al. | 294/74 |
| 3,964,776 | 6/1976 | Stott | 294/74 |

*Primary Examiner*—James B. Marbert

*Attorney, Agent, or Firm*—Joseph E. Rusz; Arsen Tashjian

[57] ABSTRACT

A sling arrangement including custom made attachment plates each with a plurality of holes therein and a cable attached therebetween for use with a portable hoist to hold the weight of a propeller pump housing while it is being removed and/or installed on an aircraft. The arrangement permits one person rather than two or three to install and/or remove the housing unit safely with a minimum of effort without danger of strain. By rotating the attachment plates 90°, the sling can be used to service the pump housing of a second series of propellers.

2 Claims, 3 Drawing Figures

PUMP HOUSING SLING

STATEMENT OF GOVERNMENT INTEREST

The invention described herein may be manufactured and used by or for the Government for governmental purposes without the payment of any royalty thereon.

BACKGROUND OF THE INVENTION

This invention relates to a sling for handling propeller pump housings and the like and, more particularly, the invention is concerned with providing a pair of attachment plates having a series of holes in alignment with corresponding holes in the pump housing and having a cable disposed between the attachment plates for engaging a hoist.

Heretofore, it has been common practice in the removal of a Hamilton Standard propeller in the 54H60-63 series for two mechanics to lift and hold the propeller housing while a third man operates a pump housing mechanical puller tool. Once the housing is free of the propeller, the two men holding the housing must carry it to a workbench or cart and gingerly set it down. Since the housing weighs approximately 117 pounds and is very cumbersome and awkward to handle, it is obvious that a great deal of effort must be expended in order to perform the operation. In fact, mechanics who perform this task have been known to injure themselves because of the weight and size of the housing being handled. Commonly available rope slings are not practical for lifting the housing because of the danger of slippage resulting in damage to the pump or injury to the workers or both.

What is needed is a sling which is specifically suited for attachment to particular propeller pumps so that the danger of slippage is eliminated and the need for extra mechanics to hold the unit is no longer necessary. Also, it would be desirable if the same attachment means could be used for the 54H60-90 series propeller housing as well. The hereinafter described pump housing sling satisfies the needs outlined and overcomes the inherent disadvantages of the present system of removing and installing propeller pump housings.

SUMMARY OF THE INVENTION

The present invention is concerned with providing a pump housing sling for safely and expeditiously removing and installing a propeller on an aircraft. A special attachment means including two custom drilled attachment plates is provided for attaching the sling to the pump housing. A cable connects between the tops of the two attachment plates for engaging the hook on a portable hoist or the like. All of the weight of the housing is held by the sling so that a single mechanic can operate the pump housing mechanical puller tool and, once the housing is free of the propeller, the housing can be easily set down in the desired location.

Accordingly, it is an object of the invention to provide pump housing sling for use in removing and/or installing of a Hamilton Standard propeller in the 54H60 series used on U.S. Air Force C130 B and E aircraft.

Another object of the invention is to provide a pump housing sling wherein all of the weight of the housing is held by the sling which is attached to a portable hoist thereby allowing one man to safely and efficiently remove or install the pump housing by himself with no chance of possible muscle strain.

Still another object of the invention is to provide a pump housing sling having two attachment plates connected to each other by a steel cable. The plates are custom drilled to fit the Hamilton Standard pump housing on series 54H60-63 and 90 propellers.

A further object of the invention is to provide a pump housing sling which includes a set of sling attachment plates which can be used on both the −63 and −90 series propeller housings. The plates are simply rotated 90° and a ¾ inch bolt is used for mounting on the −63 series housing.

A still further object of the invention is to provide a pump housing sling which eliminates the problem of having two mechanics lift and hold the housing while a third man operates the puller tool. The hereinafter described invention offers a totally new way of removing and installing the propeller control while at the same time being safer and easier than the present method.

These and other objects, features and advantages will become more apparent after considering the following detailed description taken in conjunction with the annexed drawings and appended claims.

DESCRIPTION OF A PREFERRED EMBODIMENT

Figure 1:
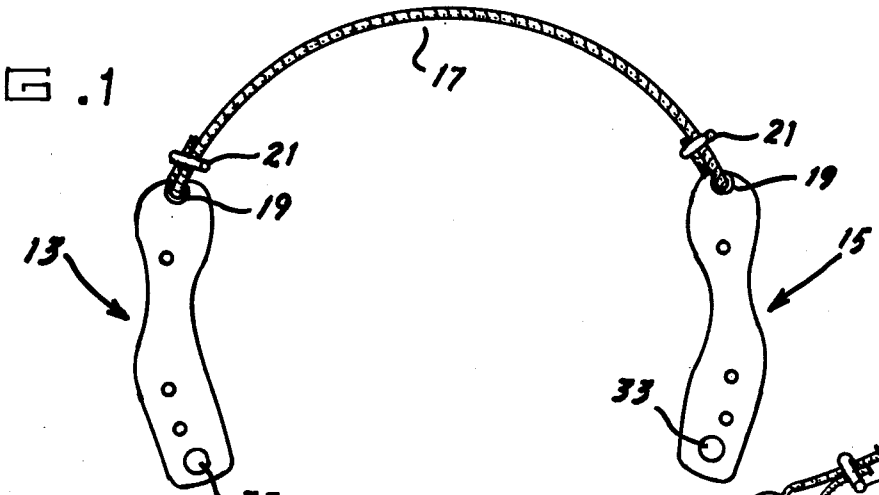
FIG. 1 is a general view of the pump housing sling according to the invention showing the left template adapter, the right template adapter and the steel cable connected therebetween.

Referring now to the drawings in which like reference numerals refer to like structural elements in the separate views, there is shown a pump housing sling according to the invention including a left template adapter 13 and a right template adapter 15. A cable 17 is connected between the upper portions of the adapter plates 13 and 15 and is attached thereto by passing through the openings 19 therein. A pair of U-clamps 21 serve to tie the cable 17 to the plates 13 and 15. In use, the cable 17 engages the hook of a portable hoist (not shown).

Figure 2:
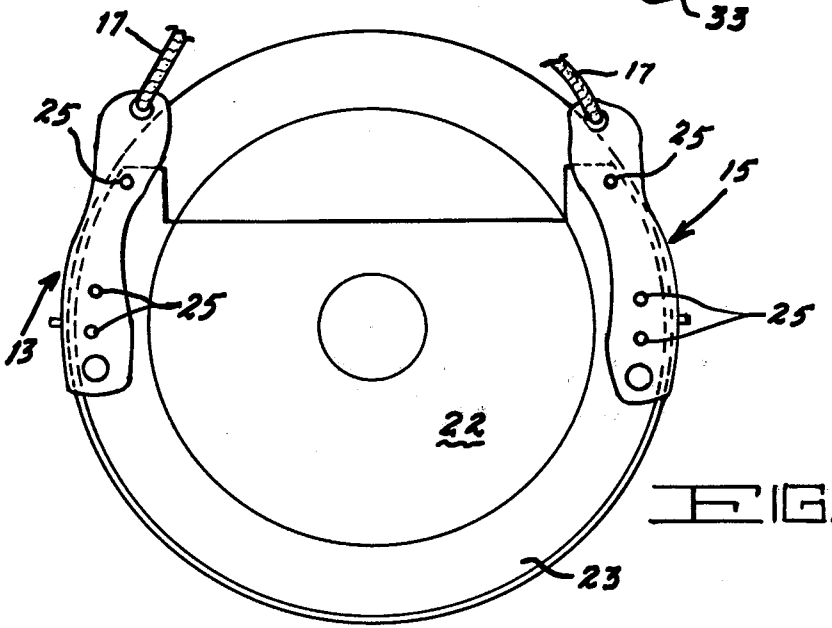
FIG. 2 is a view of the pump housing sling attached to the afterbody mounting bracket of a Hamilton Standard pump housing series 54H60-90.

In FIG. 2, the sling is shown attached to a 54H60-90 series Hamilton Standard propeller pump housing 22. The afterbody mounting bracket 23 includes three holes on each side thereof. A series of corresponding holes 25 in the left and right adapter plates 13 and 15 are provided for alignment with the holes in the afterbody mounting bracket 23 for use in attaching the plates 13 and 15 to the bracket 23. After bolting the plates 13 and 15 to the afterbody mounting bracket 23 of the pump housing 22, the hoist can be attached to the cable 17 and the housing 22 lifted so that the pump housing mechanical puller tool can be operated.

Figure 3:
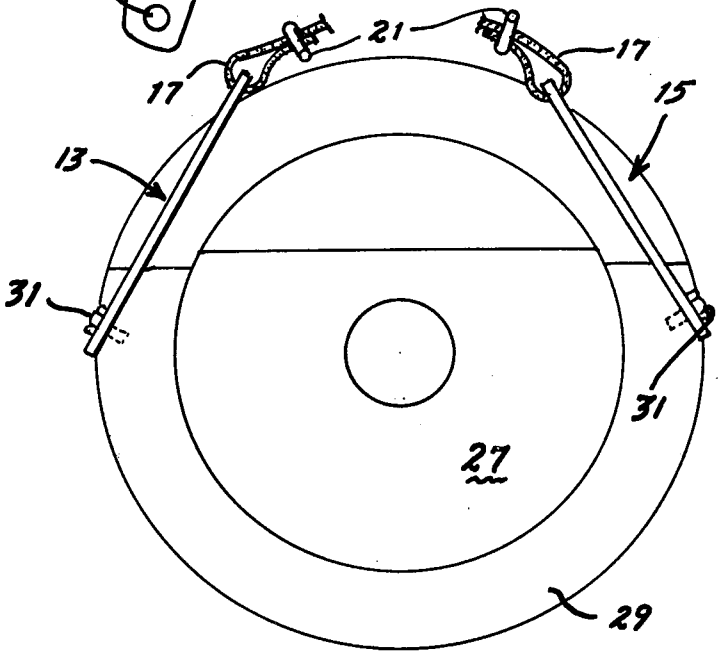
FIG. 3 is a view of the pump housing sling attached to the combined lower afterbody and bracket of a Hamilton Standard pump housing series 54H60-63.

In FIG. 3, the sling is shown attached to a 54H60-63 series Hamilton Standard propeller pump 27. With this series pump, the adapter plates 13 and 15 are rotated 90° and bolted to the combined lower afterbody and bracket 29. The bolts 31 are threaded into the bracket 29 after passing through the openings 33 in the plates 13 and 15. As in the case of the 90 series propeller housing, after the adapter plates 13 and 15 are bolted to the combined lower afterbody and bracket 29, a hoist is attached to the cable 17 and the pump housing 27 is lifted to allow the mechanic to remove it.

Thus it can be seen that the hereinbefore described invention allows the entire operation of removing and/or installing a pump housing assembly to be accomplished by one man along with a portable hoist. Formerly, two or three men were required to perform the operation. Also, the pump housing can be handled safely and more efficiently with little or no chance of injury to the mechanic or damage to the pump housing.

Although the invention has been illustrated in the foregoing specification in terms of a preferred embodiment thereof, the invention is not limited to this embodiment or to the particular configuration shown and described. It will be apparent to those skilled in the art that certain changes, modifications and substitutions can be made particularly with respect to the shape and positioning of the elements without departing from the true spirit and scope of the appended claims. Also, it can be seen that the invention has many other uses where it is necessary to lift heavy and awkward machine elements while disconnecting or performing operations thereon and for reinstalling the machine element after the required work has been done.

Having thus set forth the nature of my invention, what I claim and desire to secure by Letters Patent of the United States is:

1. A sling for removing and installing a propeller pump housing on an aircraft, said sling comprising a left template adapter having a series of holes therein in alignment with the holes in the left side of the afterbody mounting bracket of the propeller pump and bolted thereto, a right template adapter having a series of holes therein in alignment with the holes in the right side of the afterbody mounting bracket of the propeller pump and bolted thereto and a cable fixedly attached between the upper ends of said left and right template adapters for engaging a hoist means, thereby allowing the pump housing to be lifted so that the unit can be safely handled during removal and installation.

2. The sling for removing and installing a propeller pump housing defined in claim 1 wherein the left and right template adapters are rotated 90° to cause a hole in the lower portion of each to become aligned with corresponding threaded holes in the combined lower afterbody and bracket of the pump housing, and bolts threaded into said bracket to fixedly attach the sling to the pump housing.

* * * * *